US008662734B2

(12) United States Patent
Covaro

(10) Patent No.: US 8,662,734 B2
(45) Date of Patent: Mar. 4, 2014

(54) LED TRACK LIGHTING WITH FLEXIBLE CIRCUIT

(75) Inventor: Mark Covaro, Sonoma, CA (US)

(73) Assignee: Redwood Systems, Inc., Fremont, CA (US)

( * ) Notice: Subject to any disclaimer, the term of this patent is extended or adjusted under 35 U.S.C. 154(b) by 253 days.

(21) Appl. No.: 13/212,659

(22) Filed: Aug. 18, 2011

(65) Prior Publication Data

US 2012/0044691 A1 Feb. 23, 2012

Related U.S. Application Data

(60) Provisional application No. 61/376,058, filed on Aug. 23, 2010.

(51) Int. Cl.
*H01R 25/16* (2006.01)
*F21S 4/00* (2006.01)
*F21V 21/35* (2006.01)

(52) U.S. Cl.
USPC . 362/648; 362/238; 362/249.03; 362/249.04; 439/111

(58) Field of Classification Search
USPC ..... 362/217.5, 223, 224, 238, 249.02, 362/249.03, 311.02, 239, 249.04, 391, 648; 439/110, 111
See application file for complete search history.

(56) References Cited

U.S. PATENT DOCUMENTS

| | | | | | |
|---|---|---|---|---|---|
| 4,118,760 | A | * | 10/1978 | Cohon | 362/239 |
| 4,173,035 | A | * | 10/1979 | Hoyt | 362/249.04 |
| 4,245,874 | A | | 1/1981 | Bishop | 339/14 R |
| 5,051,877 | A | * | 9/1991 | Liao | 362/249.16 |
| 5,330,368 | A | * | 7/1994 | Tsuruzono | 439/409 |
| 5,967,823 | A | * | 10/1999 | Tsui | 439/280 |
| 6,318,884 | B1 | * | 11/2001 | Hibbard et al. | 362/391 |
| 6,970,090 | B1 | | 11/2005 | Sciarra | 340/573.1 |
| 7,160,140 | B1 | * | 1/2007 | Mrakovich et al. | 439/417 |
| 7,507,005 | B1 | | 3/2009 | Mier-Langner | 362/418 |
| 7,740,386 | B2 | * | 6/2010 | Tsuji et al. | 362/391 |
| 2005/0169015 | A1 | | 8/2005 | Luk et al. | 362/648 |

* cited by examiner

*Primary Examiner* — Alan Cariaso
(74) *Attorney, Agent, or Firm* — Myers Bigel Sibley & Sajovec, P.A.

(57) ABSTRACT

A flexible multi-line conductor and multiple luminaire connectors may be provided. Each one of the luminaire connectors may be coupled to a corresponding luminaire and the flexible multi-line conductor. Each of the luminaire connectors may be moveable relative to each other. The flexible multi-line conductor may bend in response to movement of any of the luminaire connectors relative to each other. The flexible multi-line conductor may include multiple conductors. Each one of the luminaire connectors may couple a corresponding one of the luminaires to a different set of the conductors than the other luminaire connectors couple to the other luminaires.

15 Claims, 6 Drawing Sheets

LED TRACK LIGHTING WITH FLEXIBLE CIRCUIT

This application claims priority under 35 U.S.C. §119(e) to U.S. Provisional Application No. 61/376,058, "LED TRACK LIGHTING WITH FLEXIBLE CIRCUIT" filed Aug. 23, 2010, the entire contents of which are incorporated by reference.

BACKGROUND

1. Technical Field

This application relates to light fixtures and, in particular, to track lighting.

2. Related Art

Existing track lighting luminaires use high voltage, such a, 120 Volts AC (alternating current). Track lighting units are usually wired in parallel with each other. Existing tracks usually have three conductors. For example, the three conductors provide for a hot, neutral, and safety ground. Luminaires may be connected in parallel electrically when the luminaires are installed in the track. In existing tracks, the track conductors may be embedded in the walls of the track. Each of the luminaires may slide onto the track, sharing the same track conductors with the other luminaires on the track, and, thus, are electrically connected in parallel with each other.

SUMMARY

A track lighting system may be provided that includes a track, multiple luminaire connectors, and a flexible multi-line conductor. Each of the luminaire connectors may be configured to couple with a corresponding luminaire. Each of the luminaire connectors may be moveable relative to the track. The flexible multi-line conductor may include multiple conductors. Each of the luminaire connectors may be configured to power the corresponding luminaire from a corresponding set of the conductors. The respective set of the conductors from which each of the luminaire connectors powers the corresponding luminaire may be different than the other sets of the conductors from which the other luminaire connectors power the other luminaires. The flexible multi-line conductor may bend in response to movement of any of the luminaire connectors relative to the track.

A flexible conductor assembly for lighting may be provided that includes a flexible multi-line conductor and multiple luminaire connectors. The luminaire connectors may be configured to couple to luminaires. Each of the luminaire connectors may be moveable relative to each other. The flexible multi-line conductor may include multiple conductors. Each of the luminaire connectors may be configured to couple a corresponding one of the luminaires to a different set of the conductors than the other luminaire connectors are configured to couple to the other luminaires. The flexible multi-line conductor may flex in response to movement of any of the luminaire connectors relative to each other.

A method to distribute power to a lighting system may be provided. Luminaires may be provided that may be moved relative to each other. A flexible multi-line conductor may be provided that includes multiple conductors. Each of the luminaires may be coupled to the flexible multi-line conductor. The luminaires may be positioned relative to each other, and the flexible multi-line conductor may bend in response to movement of any of the luminaires relative to the each other during positioning the luminaires. A set of the conductors may be selected to power each respective one of the luminaires, where the set of the conductors for each respective one of the luminaires is different than for the other luminaires.

Further objects and advantages of the present invention will be apparent from the following description, reference being made to the accompanying drawings wherein preferred embodiments of the present invention are shown.

BRIEF DESCRIPTION OF THE DRAWINGS

The embodiments may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

In one example, a track lighting system may be provided that includes a track, multiple luminaire connectors, and a flexible multi-line conductor. Each of the luminaire connectors may be configured to couple with a corresponding luminaire. Each of the luminaire connectors may be moveable relative to the track. For example, the luminaire connectors may move freely in a housing of the track. Alternatively, channels in the luminaire connectors may receive rails in the housing so that the luminaire connectors may slide along the track. The flexible multi-line conductor may include multiple conductors. For example, the flexible multi-line conductor may be a flex circuit. Each one of the luminaire connectors may be configured to power the corresponding luminaire from a corresponding subset of the conductors. The respective set of the conductors from which each of the luminaire connectors powers the corresponding luminaire may be different than the other sets of the conductors from which the other luminaire connectors power the other luminaires. The flexible multi-line conductor may bend in response to movement of any of the luminaire connectors relative to the track.

One interesting feature of the systems and methods described below is that the luminaires may be powered by separate pairs of conductors. Another interesting feature of the systems and methods described below is that the set of conductors that power a corresponding luminaire may be dynamically selected.

Figure 1:
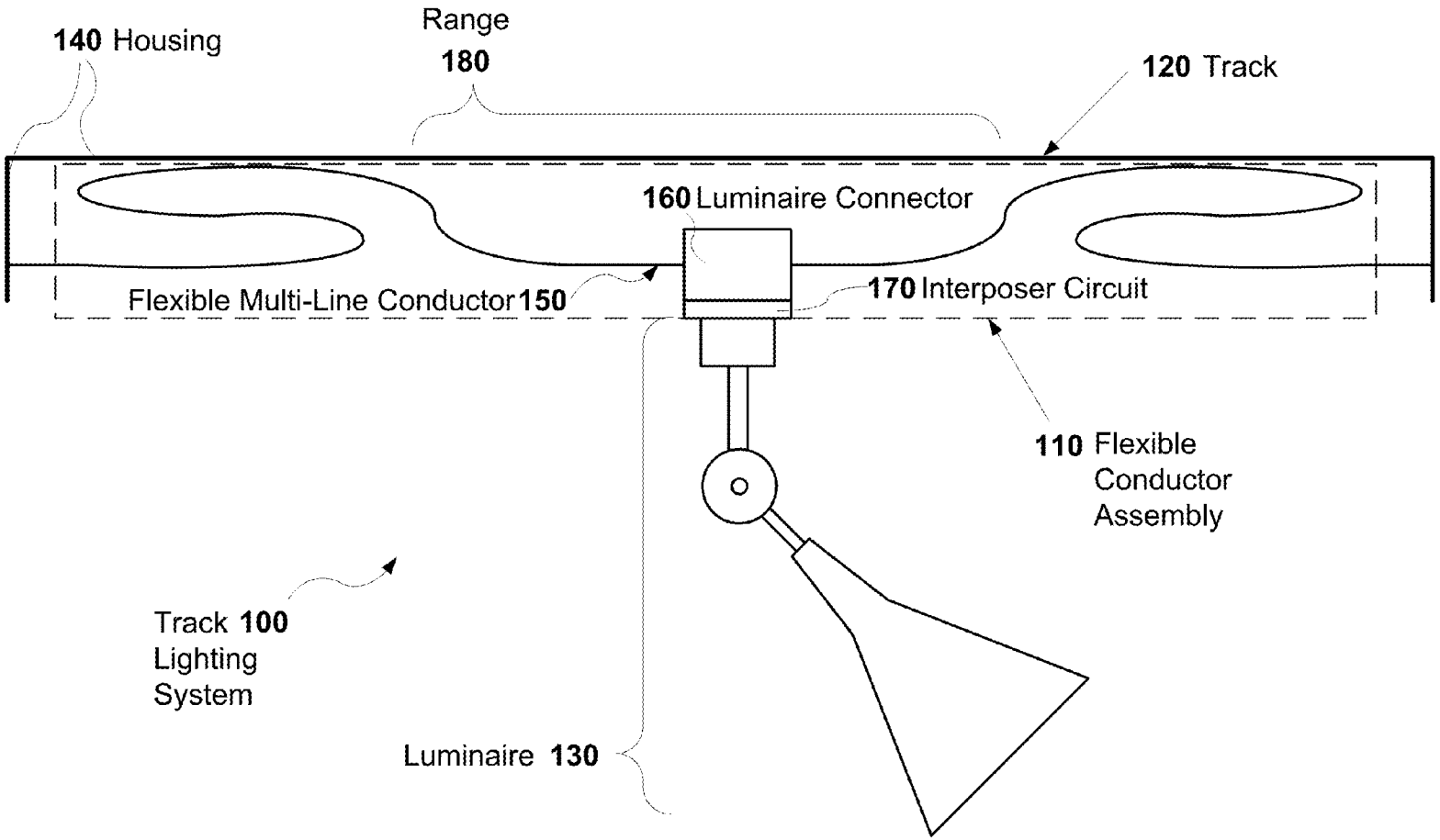
FIG. 1 illustrates an example of a track lighting system with a flexible conductor assembly.

FIG. 1 illustrates an example of a track lighting system 100 with a flexible conductor assembly 110. The track lighting system 100 may include a track 120, the flexible conductor assembly 110, and one or more light fixtures or luminaires 130 that receive power from the flexible conductor assembly 110.

The track 120 may be a component that couples to the luminaires 130 using any mechanism for positioning the luminaires 130 along the track 120. For example, the track 120 may include a housing 140 that couples to the luminaires 130. The housing 140 may include rails over which channels in the luminaire 130 slide. In an alternative example, the track 120 may not include the housing 140. Instead, the track 120 may comprise a single rail that is received by a single channel of the luminaire 130. The track 120 may be flexible or rigid.

The flexible conductor assembly 110 may be a component that provides power to the luminaire or luminaires 130. The flexible conductor assembly 110 may include a flexible multi-line conductor 150 and a luminaire connector 160 to which the corresponding luminaire 130 is electrically coupled. In at least one example, the flexible conductor assembly 110 may include an interposer circuit 170.

The flexible multi-line conductor 150 may be any component that includes multiple pairs of conductors and is flexible. Examples of the flexible multi-line conductor 150 include a flex circuit, a flexible circuit, a flexible circuit assembly, a flexible printed circuit (FPC), a flex circuit tape, a ribbon cable, or any other device that includes multiple sets of conductors and is flexible. The flexible multi-line conductor 150 may be considered flexible if the flexible multi-line conductor 150 may bend at least 180 degrees without breaking. The flexible printed circuit may include a patterned arrangement of printed wiring on a flexible base material with or without flexible cover layers. The flexible multi-line conductor 150 may be formed, for example, by mounting electronic devices on one or more flexible plastic substrates. The multiple conductor pairs may be represented as individual circuits in the flexible circuit tape.

The luminaire connector 160 may include a component that electrically couples the luminaire 130 to the flexible multi-line conductor 150 so that the luminaire 130 may be powered through at least a subset of the conductors in the flexible multi-line conductor 150. In particular, the luminaire connector 160 may facilitate electrically coupling the luminaire 130 to a subset of the conductors in the flexible multi-line conductor 150. The luminaire connector 160 may include a block that comprises, for example, non-conducting material, such as plastic. The block may be of any suitable shape. In one example, the block may include features that facilitate attachment to the track 120, such as a channel that receives a rail included in the housing 140 or a rail that is received by a channel included in the track 120. The luminaire connector 160 may include a conductor connector. The conductor connector may include electrical contacts electrically coupled to corresponding conductors in the flexible multi-line conductor 150. The conductor connector may accept, or otherwise couple with, the interposer circuit 170, the luminaire 130, or both. The luminaire connector 160 may include a transition mechanism for electrical connections from the flexible multi-line conductor 150 to the conductor connector. The transition mechanism may include, for example, wires, connectors, circuits, or any other type of electrical device or devices. The luminaire connector 160 may include electrical contacts that come into contact with one or more of the conductors in the flexible multi-line conductor 150.

The interposer circuit 170 may be a circuit that selects a subset of the conductors in the flexible multi-line conductor 150 to power the luminaire 130. The interposer circuit 170 is described later below in more detail. The interposer circuit 170 may be included in the luminaire connector 160. Alternatively or in addition, the interposer circuit 170 may be inserted into the luminaire connector 160 or otherwise coupled to the luminaire connector 160. For example, the luminaire connector 160 may clamp the interposer circuit 170 to the flexible multi-line conductor 150. Examples of the interposer circuit 170 may include a circuit board, a wafer, or any other type of circuit.

The luminaire 130 may include any electrical device or combination of devices that create artificial light from electricity. The luminaire 130 may distribute, filter or transform the light from one or more lamps included or installed in the light luminaire 130. Alternatively or in addition, the luminaire 130 may include one or more lamps and/or ballasts. The lamps may include an incandescent bulb, a LED (Light-Emitting Diode) light, a fluorescent light, a CFL (compact fluorescent lamp), a CCFL (Cold Cathode Fluorescent Lamp), halogen lamp, or any other device now known or later discovered that generates artificial light. Examples of the luminaire 130 include a spot light, a cylindrical track light head, a rectangular track light head, a gimbal ring head, or any other device or apparatus that includes one or more lamps. References to the luminaires 130 may also be understood to apply to one or more lamps within the luminaire 130.

During operation of the track lighting system 100, an installer may manually move the luminaire 130 along the track 120 to a desired position. The flexible multi-line conductor 150 of the flexible conductor assembly 110 may bend or flex in response to moving the luminaire 130 along the track 120. The luminaire 130 may receive power over a subset of the conductors in the flexible multi-line conductor 150 regardless of the position of the luminaire 130 within a range 180 along the track 120.

The subset of the conductors may be determined by the luminaire connector 160. Alternatively or in addition, the subset of the conductors may be determined by the interposer circuit 170.

Figure 2:
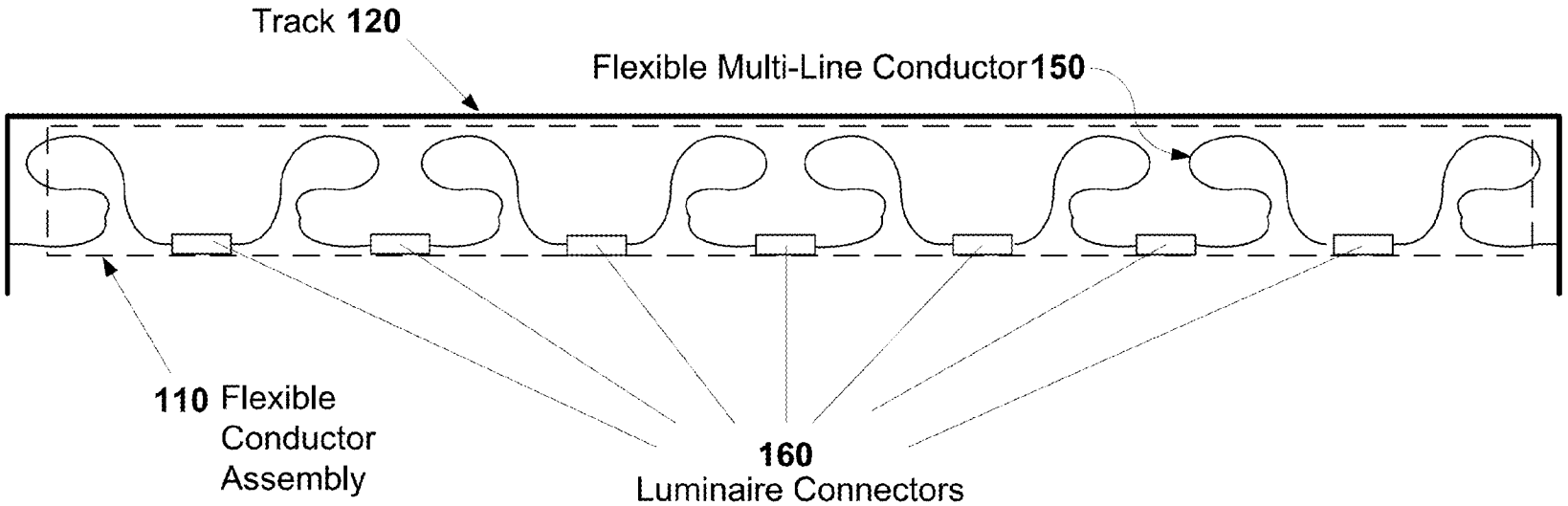
FIG. 2 illustrates an example of a track lighting system with multiple luminaire connectors.

The track lighting system 100 may include additional, fewer, or different components. For example, the flexible conductor assembly 110 of the track lighting system 100 may include multiple luminaire connectors 160, as illustrated in FIG. 2. Alternatively or in addition, the track lighting system 100 may include multiple flexible conductor assemblies 110 that are daisy chained together along the track 120. The track 120 may include multiple sections that are coupled together to form the length of the track 120.

The track lighting system 100 may be implemented in many different ways. For example, luminaire connector 160 of the flexible conductor assembly 110 may slide along a rail or rails in the track 120. The luminaire connector 160 may then physically couple the luminaire 130 to the track 120. Alternatively, the luminaire connector 160 may move freely within the housing 140 of the track 120. Channels in the luminaire 130 may receive rails in the housing 140 of the track 120 in order to physically couple the luminaire 130 to the track 120. The luminaire connector 160 may then supply power to the luminaire 130, but not physically couple the luminaire 130 to the track 120.

In one embodiment, the track lighting system 100 may not include the flexible conductor assembly 110 as described above. Instead, the track lighting system 100 may include the flexible multi-line conductor 150 positioned flush against the base or side of the housing 140. The conductors of the flexible multi-line conductor 150 may be exposed so that contacts on the luminaire connector 160 touch corresponding exposed conductors of the flexible multi-line conductor 150. Accordingly, the luminaire connector 160 may receive power from at least two of the conductors of the flexible multi-line conductor 150 regardless of the position of the luminaire 130 within the range 180 along the track 120. Similarly, the track lighting system 100 may include the flexible multi-line conductor 150 positioned flush against the side of the track 120 if the track 120 is a monorail. If the luminaire 130 is repositioned along the track 120, then the contacts on the luminaire connector 160 may remain in contact with the corresponding exposed conductors of the flexible multi-line conductor 150 on the monorail.

Figure 3:
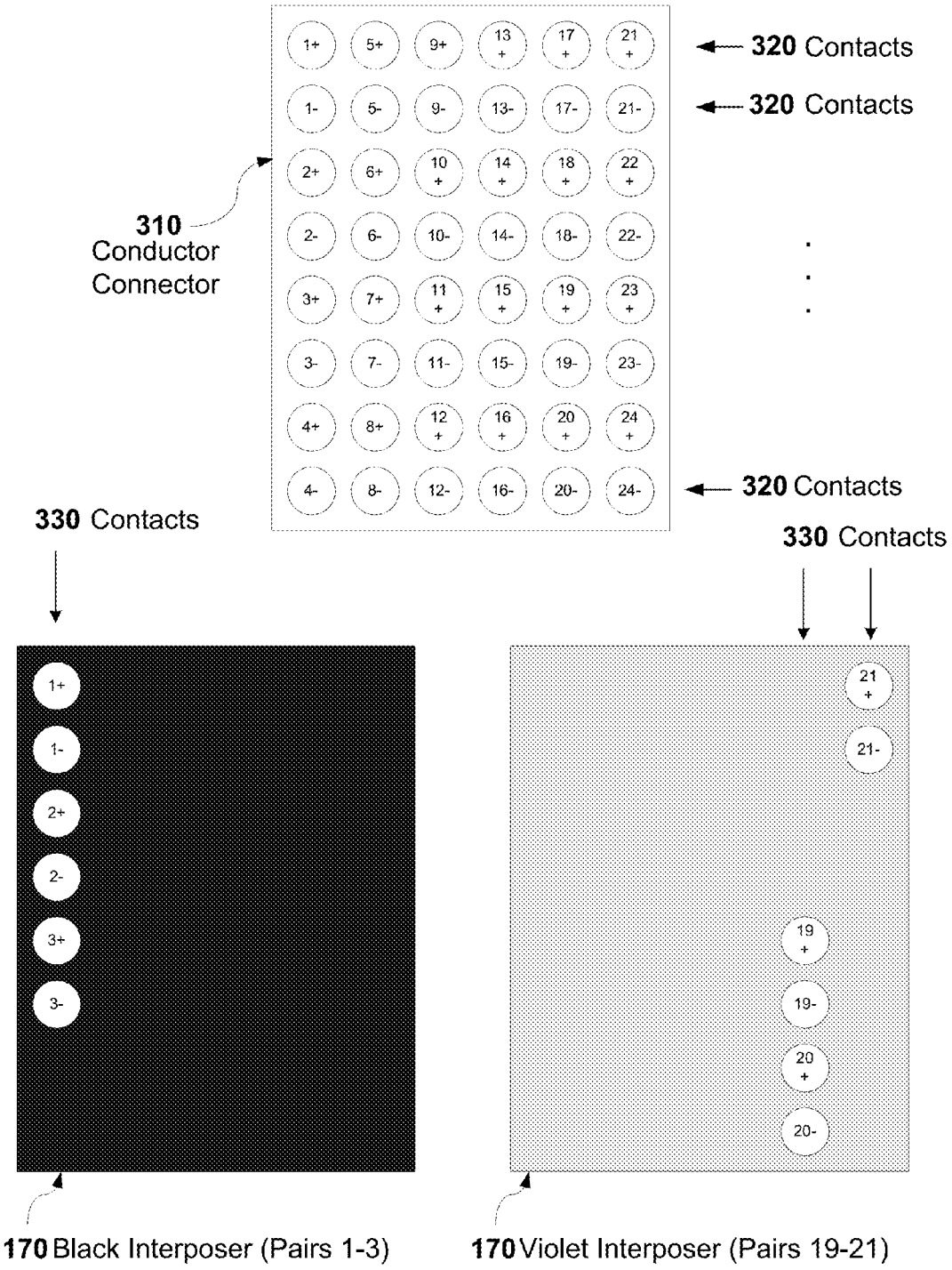
FIG. 3 illustrates two example interposer circuits.

FIG. 3 illustrates two example interposer circuits 170, each of which may couple with a conductor connector 310 in the luminaire connector 160 or in the flexible multi-line conductor 150. The two interposer circuits 170 are individually designated Black Interposer and Violet Interposer, respectively.

The conductor connector 310 may provide pairs of contacts 320 (individually designated 1+ and 1− through 24+ and 24−) that are electrically coupled to corresponding pairs of conductors in the flexible multi-line conductor 150. The contacts 320 illustrated in FIG. 3 are circular shaped contacts. However, the contacts 320 may be any shape, such as rectangular or even strips that run the width or length of the conductor connector 310. Examples of the conductor connector 310 may include a Molex connector that is one of a two-piece pin and socket interconnection; a press fit edge connector; a printed pattern on the flexible multi-line conductor 150; contact pins, such as Fuzz Buttons®, which is a registered trademark of Custom Interconnects, LLC of Denver, Colo.; pogo pins; conductive elastomer; metal springs, or any other type of connector.

The conductor connector 310 may be included in the luminaire connector 160. For example, the conductor connector 310 may be included on a surface of the luminaire connector 160 that faces away from the housing 140 of the track 120. Alternatively or in addition, the conductor connector 310 may be a discrete component that couples to the luminaire connector 160, the flexible multi-line conductor 150 or a combination thereof. Alternatively, the conductor connector 310 may be included in the flexible multiline conductor 150. For example, the conductor connector 310 may be etched or a printed on the flexible multi-line conductor 150.

As indicated above, the interposer circuit 170 may be a circuit that selects a set of the conductors in the flexible multi-line conductor 150 to power the luminaire 130. The interposer circuit 170 that is designated the Black Interposer in FIG. 3 selects three pairs of the conductors, designated (1+, 1−), (2+, 2−), and (3+, 3−), respectively. In particular, the Black Interposer is configured so that contacts 330 on the interposer circuit 170 for the three designated pairs of conductors will electrically couple with the contacts 320 of the conductor connector 310 for the three designated pairs of conductors when the interposer circuit 170 is brought into contact with the conductor connector 310. The interposer circuit 170 may include a Molex connector that is either one of a two-piece pin and socket interconnection; a press fit edge connector; a printed pattern on the flexible multi-line conductor 150; contact pins, such as Fuzz Buttons®, which is a registered trademark of Custom Interconnects, LLC of Denver, Colo.; pogo pins; conductive elastomer; metal springs, or any other type of connector. Similarly, the interposer circuit 170 that is designated Violet Interposer in FIG. 3 selects three pairs of the conductors, designated (19+, 19−), (20+, 20−), and (21+, 21−), respectively. Accordingly, the interposer circuit 170 for each respective one of the luminaires 130 may select a different set of the conductors in the flexible multi-line conductor 150 than the interposer circuits 170 for the other luminaires 130. For example, the Black Interposer may be for a first one of the luminaires 130, and the Violet Interposer may be for a second one of the luminaires 130. Accordingly, each of the luminaires 130 may be powered by a different set of the conductors in the flexible multi-line conductor 150 than the other luminaires 130.

Each of the interposer circuits 170 may be identified with an identifier that an installer may use to determine which set of the conductors in the flexible multi-line conductor 150 is selected by the interposer circuit 170. For example, the interposer circuits 170 may be color-coded, such as is illustrated in FIG. 3. Alternatively or in addition, the interposer circuits 170 may be labeled with any other type of indicator, such as a number, a letter, a list of conductor identifiers, or a combination thereof. In one example, interposer circuit 170, the luminaire 130, the luminaire connector 160, or any combination thereof, may be constructed to hide the interposer circuit 170 so that the color or other type of indicator is not visible after installation.

Each of the interposer circuits 170 illustrated in FIG. 3 differ physically from each other in that the position of the contacts 330 on the interposer circuit 170 dictate the set conductors that power the luminaire 130. In other words, the interposer circuit 170 may make a connection with different physical positions on the conductor connector 310. Note that the example illustrated in FIG. 3 shows three pairs of conductors per luminaire 130, but any number or pairs may be used. A suitable interposer arrangement may be provided that matches the number of pairs used in a particular application. In one example, two or more interposer circuits 170 that have the same physical structure and couple to the same set of conductors in the flexible multi-line conductor 150 may be used for two or more luminaires 130. A power source may provide enough power over the set of conductors to power the combination of the two or more luminaires 130 that are electrically coupled to the set of conductors.

In an alternative example, the interposer circuits 170 may not physically differ. Instead, for example, each of the interposer circuits 170 may include the contacts 330 for all of the contacts 320 that are on the conductor connector 310. Each of the interposer circuits 170 may include logic that dynamically selects a subset of the conductors in the flexible multi-line conductor 150 to power the luminaire 130 coupled to the interposer circuit 170.

The logic of the interposer circuit 170 that selects the subset of the conductors may operate in any number of ways. In one embodiment, the logic may communicate with a power device over one or more of the conductors. The power device may provide power over the conductors and may communicate over the conductors. Examples of the power device are described in U.S. Patent Application Publication 2010/0237695 A1, entitled "SMART POWER DEVICE," which published Sep. 23, 2010. In one example, the logic in the interposer circuits 170 may send one or more request signals to the power device on each of the conductor pairs requesting power. The power device may receive the requests from all of the interposer circuits 170 on all of the conductor pairs. The power device may then determine which subset of the conductor pairs is to be assigned to which interposer circuit 170. The power device may then send an assignment signal on one or more of the pairs to each of the interposer circuits 170 indicating to each of the interposer circuits 170 which respective subset of the conductors to draw power from. In response to receipt of the assignment signal, the logic in each of the interposer circuits 170 may select the corresponding assigned set of the conductors indicated in the assignment signal.

In a second embodiment, the interposer circuits 170 may communicate with each other over one or more of the conductors in the flexible multi-line conductor 150. The interposer circuits 170 may thereby negotiate which subset of the conductor pairs are to be assigned to which of the interposer circuits 170.

Figure 4:
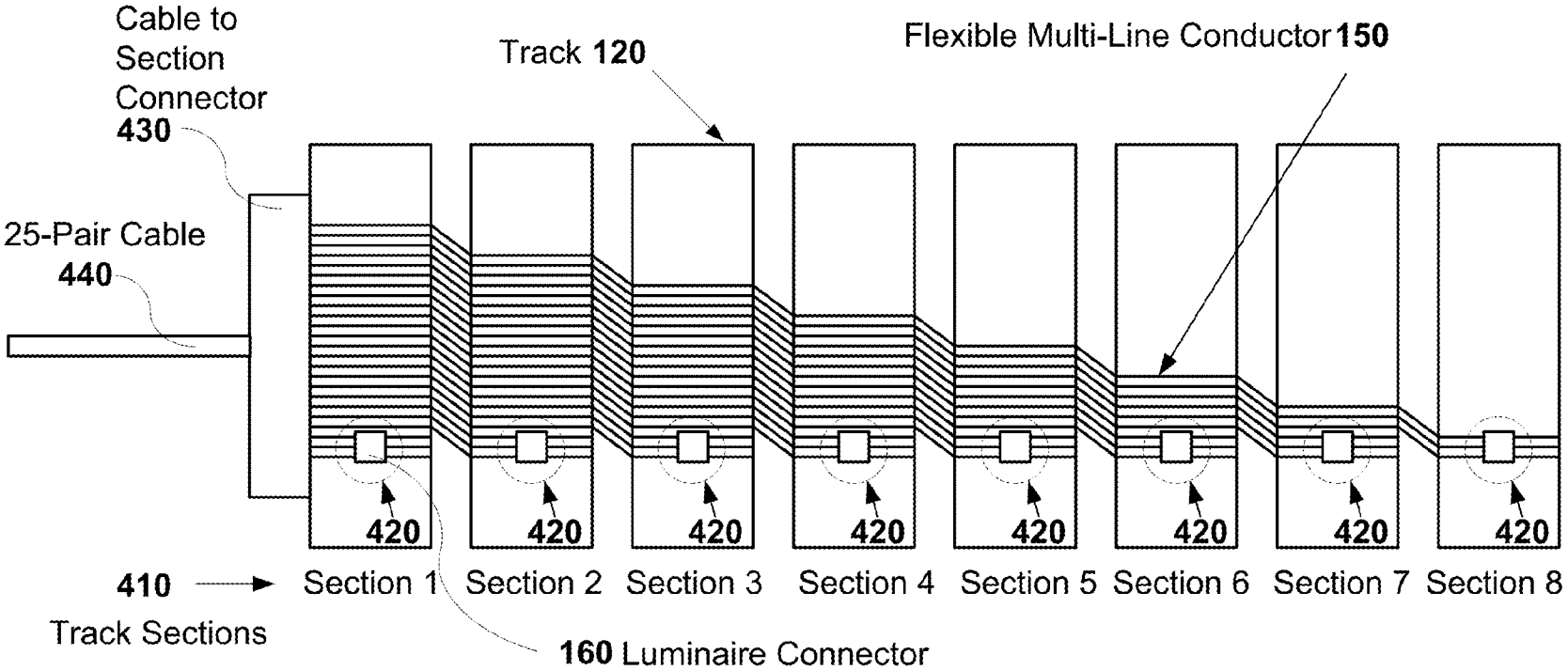
FIG. 4 illustrates an example of a track that is divided into sections where the flexible multi-line conductor provides a different set of conductors to the corresponding luminaire connector in each track section.

FIG. 4 illustrates an example of the track 120 that is divided into sections 410 where the flexible multi-line conductor 150 provides a different set of conductors to the corresponding luminaire connector 160 in each track section 410. The track sections 410 may be physical segments or physical sections that are coupled together to form the track 120. Alternatively or in addition, the track sections 410 may be logical divisions of a length of the track 120. Each line in the flexible multi-line conductor 150 that is illustrated in FIG. 4 includes a pair of conductors that represent a hot and a return.

In each of the track sections 410, the corresponding luminaire connector 160 may electrically couple with the flexible multi-line conductor 150 at the same location 420. Nevertheless, the flexible multi-line conductor 150 may present a different set of the conductors at that location 420 than in the other track sections 410.

For example, if each of the luminaires 130 uses three pairs of conductors and 24 pairs of conductors are included in the flexible multi-line conductor 150, then the 24 pairs of conductors may supply power to eight track sections 410. The flexible multi-line conductor 150 may present the first three pairs of conductors at the location 420 in Section 1, the second three pairs of conductors at the location 420 in Section 2, the third three pairs of conductors at the location 420 in Section 3, and so on, for the track sections 410 designated Section 4 through Section 8. Any number of pairs of conductors may be provided by the flexible multi-line conductor 150 at the location 420. Each of the luminaires 130 may draw power from any number of the conductors. The track 120 may be divided into any number of track sections 410.

Accordingly, each one of the luminaire connectors 160 may be the same as the other, and, if included, each of the interposer circuits 170 may be the same as the other interposer circuits 170. The single flexible multi-line conductor 150 may span the multiple track sections 410. Therefore, inventory management may be simplified by reusing common parts for the luminaire connectors 160, the interposer circuits 170, and the flexible multi-line conductor 150.

A cable-to-section connector 430 may couple a cable 440 to the flexible multi-line conductor 150. The cable 440 may supply power to the conductors in the flexible multi-line conductor 150. For example, the cable 440 may be a 25-pair cable, such as a CAT 5E cable, that provides power generated by a power device over pairs of conductors in the cable 440. The cable-to-section connector 430 may include any suitable connector, such as a Molex connector that includes a two-piece pin and socket interconnection.

Figure 5:
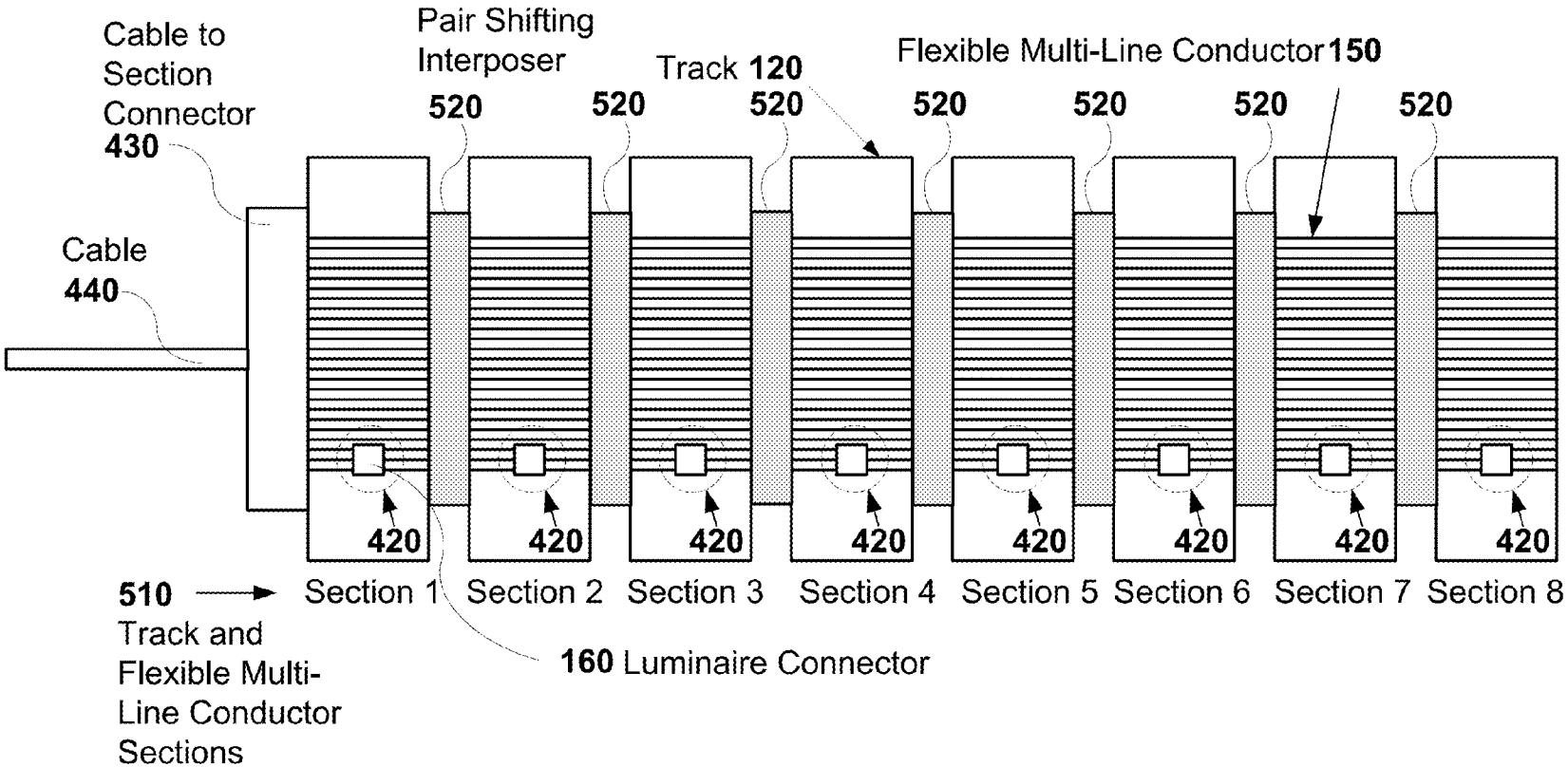
FIG. 5 illustrates an example of a track and a flexible multi-line conductor divided into sections, where a pair shifting interposer is positioned between adjacent sections of the multi-line conductor.

FIG. 5 illustrates an example of the track 120 and the flexible multi-line conductor 150 being divided into sections 510, where a pair shifting interposer 520 positioned between adjacent sections 510 of the multi-line conductor 150 electrically couples the adjacent sections 510 of the multi-line conductor 150. In each of the sections 510, the corresponding luminaire connector 160 may electrically couple with the flexible multi-line conductor 150 at the same location 420 as in the other sections 510. However, the pair shifting interposer 520 may shift a set of conductors of a first section 510 of the flexible multi-line conductor 150 to a different set of conductors of a second section 510 of the flexible multi-line conductor 150. Accordingly, the flexible multi-line conductor 150 may present to the luminaire connector 160 a different set of the conductors at that location 420 than in the other track sections 510.

For example, the pair shifting interposer 520 may electrically couple conductor pairs k+1 through n of a first section 510 to conductor pairs 1 through n−k of a second section 510 that is adjacent to the first section 510, where k is the number of conductor pairs used by each of the luminaires 130, and n is the number of conductor pairs available in the flexible multi-line conductor 150. The luminaire connector 160 in the first section 510 may electrically couple with conductor pairs 1 through k of the first section 510. The luminaire connector 160 in the second section 510 may electrically couple with conductor pairs 1 through k of the second section 510, which the pair shifting interposer 520 electrically coupled to conductors pairs k+1 through k+k of the first section 510. In other words, each pair shifting interposer 520 may shift the conductor pairs of any section 510 down k pairs in an adjacent section 510. Accordingly, by chaining together the sections 510 of the flexible multi-line conductor 150 with the pair shifting interposer 520, each of the luminaire connectors 160 may be electrically coupled with a different set of conductors in the cable 440 than the other luminaire connectors 160.

The sections 510 of the track 120 may be logical or physical sections. The sections 510 of the flexible multi-line conductors 150 may be physically discrete sections that are coupled together with the pair shifting interposers 520.

Accordingly, each one of the luminaire connectors 160 may be the same as the other luminaire connectors 160. If included in the system 100, each of the interposer circuits 170 may be the same as the other interposer circuits 170. Each of the sections 510 of the flexible multi-line conductor 150 may be the same as the other sections 510. Each of the pair shifting interposers 520 may be the same as the other pair shifting interposers 520. Therefore, inventory management may be simplified by reusing common parts.

The pair shifting interposer 520 may be implemented as a connector where leads on a first end of the connector are wired to corresponding leads on a second end of the connector such that the leads corresponding to one set of conductor pairs on the first end of the connector are shifted to leads corresponding to a second set of conductor pairs on the second end of the connector. Alternatively, the pair shifting interposer 520 may be implemented using any other type of circuit or connector.

The flexible conductor assembly 110 may be used in any type of lighting system that includes multiple luminaires. For example, the flexible conductor assembly may be included in cove lighting or linear lighting. Cove lighting may be a form of indirect lighting built into ledges, recesses, or valences in a ceiling or high on the walls of a room. Cove lighting may direct light up towards a ceiling or down towards an adjacent wall, for example. Accordingly, the system 100 may be for a type of lighting system other than track lighting.

The system 100, the luminaire connector 160, and the interposer circuit 170, may be implemented in many different ways. For example, the luminaire connector 160 and/or the interposer circuit 170 may include a processor and a memory. The memory may hold the programs and processes that implement the logic described above for execution by the processor. As examples, the memory may store program logic that implements the features of the interposer circuit 170. Although features may stored in computer-readable memories (e.g., as logic implemented as computer-executable instructions or as data structures in memory), the features and corresponding logic and data structures may be stored on, distributed across, or read from other machine-readable media. The media may include hard disks, floppy disks, CD-ROMs, a signal, such as a signal received from a network or received over multiple packets communicated across the network.

The system 100 may be implemented with additional, different, or fewer entities. For example, the system 100 may not include the track 120 if the system 100 is not a track lighting system. As another example, the interposer circuit 170 may be included in the luminaire connector 160. Alternatively, the system 100 may not include the interposer circuit 170 at all. As yet another example, the processor may be implemented as a microprocessor, a microcontroller, a DSP, an application specific integrated circuit (ASIC), discrete logic, or a combination of other types of circuits or logic. As still another example, the memory may be a non-volatile and/or volatile memory, such as a random access memory (RAM), a read-only memory (ROM), an erasable programmable read-only memory (EPROM), flash memory, any other type of memory now known or later discovered, or any combination thereof. The memory may include an optical, magnetic (hard-drive) or any other form of data storage device.

The processing capability of the system 100 may be distributed among multiple entities, such as among multiple processors and memories, optionally including multiple distributed processing systems. Parameters, databases, and other data structures may be separately stored and managed, may be incorporated into a single memory or database, may be logically and physically organized in many different ways, and may implemented with different types of data structures such as linked lists, hash tables, or implicit storage mechanisms. Logic, such as programs or circuitry, may be combined or split among multiple programs, distributed across several memories and processors, and may be implemented in a library, such as a shared library (e.g., a dynamic link library (DLL)).

The processor may be in communication with the memory. In one example, the processor may also be in communication with additional elements, such as the power device. The processor may be a general processor, central processing unit, server, application specific integrated circuit (ASIC), digital signal processor, field programmable gate array (FPGA), digital circuit, analog circuit, or combinations thereof.

The processor may be one or more devices operable to execute computer executable instructions or computer code embodied in the memory or in other memory to perform the features of the system 100. The computer code may include instructions executable with the processor. The computer code may include embedded logic. The computer code may be written in any computer language now known or later discovered, such as C++, C#, Java, Pascal, Visual Basic, Perl, Hypertext Markup Language (HTML), JavaScript, assembly language, shell script, or any combination thereof. The computer code may include source code and/or compiled code.

Figure 6:
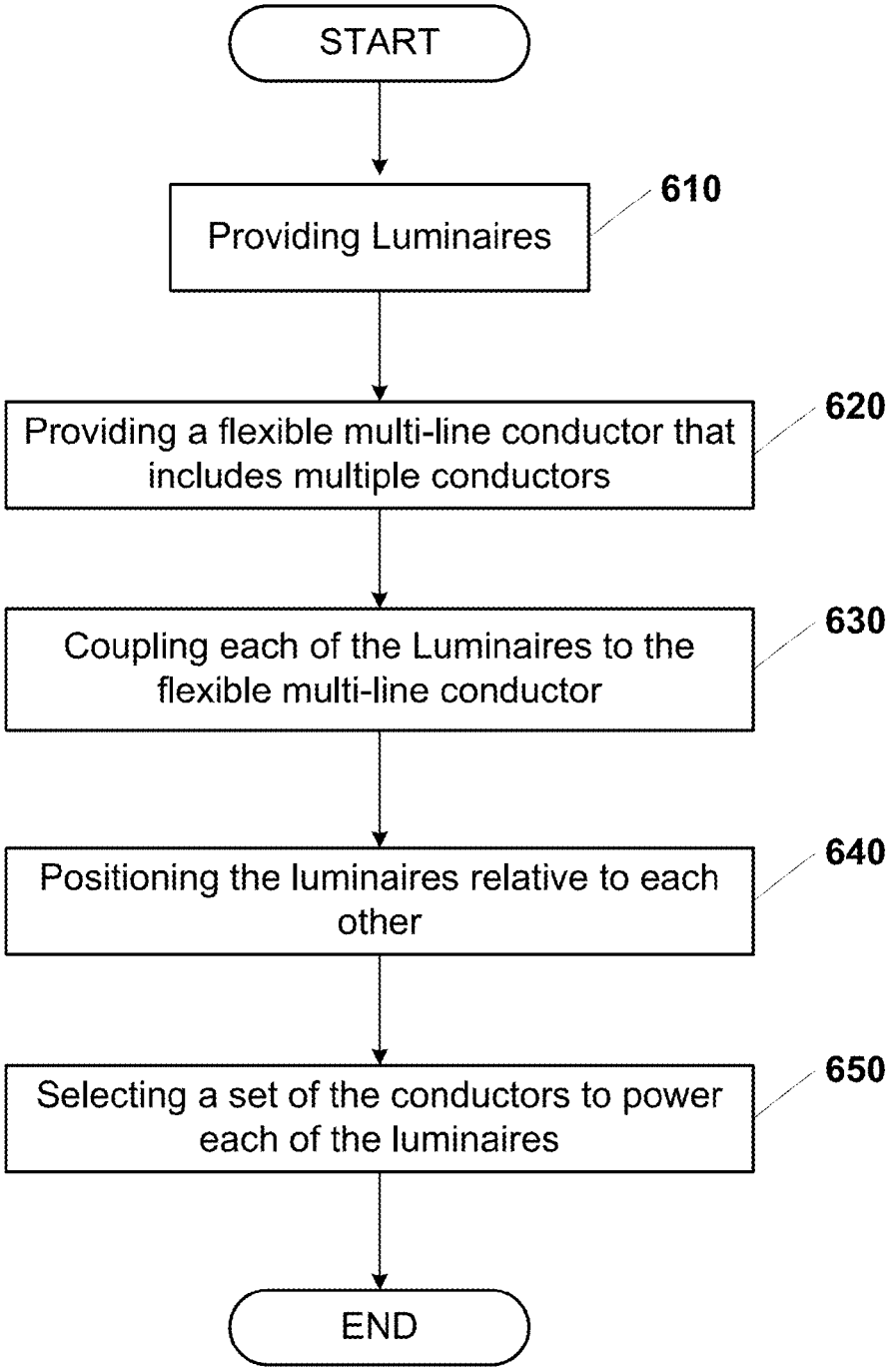
FIG. 6 illustrates an example flow diagram of the logic of a lighting system.

FIG. 6 illustrates an example flow diagram of the logic of the lighting system 100. The logic may include additional, different, or fewer operations. The operations may be executed in a different order than illustrated in FIG. 6.

In a first operation, the luminaires 130 may be provided such that each of the luminaires 130 is moveable relative to the other luminaires 130 (610). The flexible multi-line conductor 150 may also be provided (620).

Each of the luminaires 130 may be coupled to the flexible multi-line conductor 150 (630). The luminaires 130 may be positioned relative to each other (640). For example, the luminaires 130 may be positioned along the track 120 or positioned in cove or linear lighting. The flexible multi-line conductor 150 may bend in response to movement of any of the luminaires 130 relative to the each other when positioning the luminaires 130.

The operations may end, for example, when a set of the conductors in the flexible multi-line conductor 150 are selected to power each respective one of the luminaires 130, where the set of the conductors for each respective one of the luminaires 130 is different than for the other luminaires 130 (650).

All of the discussion, regardless of the particular implementation described, is exemplary in nature, rather than limiting. For example, although selected aspects, features, or components of the implementations are depicted as being stored in memories, all or part of systems and methods consistent with the innovations may be stored on, distributed across, or read from other computer-readable storage media, for example, secondary storage devices such as hard disks, floppy disks, and CD-ROMs; or other forms of ROM or RAM either currently known or later developed. The computer-readable storage media may be non-transitory computer-readable media, which includes CD-ROMs, volatile or non-volatile memory such as ROM and RAM, or any other suitable storage device. Moreover, the various modules and screen display functionality is but one example of such functionality and any other configurations encompassing similar functionality are possible.

Furthermore, although specific components of innovations were described, methods, systems, and articles of manufacture consistent with the innovation may include additional or different components. For example, a processor may be implemented as a microprocessor, microcontroller, application specific integrated circuit (ASIC), discrete logic, or a combination of other type of circuits or logic. Similarly, memories may be DRAM, SRAM, Flash or any other type of memory. Flags, data, databases, tables, entities, and other data structures may be separately stored and managed, may be incorporated into a single memory or database, may be distributed, or may be logically and physically organized in many different ways. The components may operate independently or be part of a same program. The components may be resident on separate hardware, such as separate removable circuit boards, or share common hardware, such as a same memory and processor for implementing instructions from the memory. Programs may be parts of a single program, separate programs, or distributed across several memories and processors.

The respective logic, software or instructions for implementing the processes, methods and/or techniques discussed above may be provided on computer-readable media or memories or other tangible media, such as a cache, buffer, RAM, removable media, hard drive, other computer readable storage media, or any other tangible media or any combination thereof. The tangible media include various types of volatile and nonvolatile storage media. The functions, acts or tasks illustrated in the figures or described herein may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing and the like. In one embodiment, the instructions are stored on a removable media device for reading by local or remote systems. In other embodiments, the logic or instructions are stored in a remote location for transfer through a computer network or over telephone lines. In yet other embodiments, the logic or instructions are stored within a given computer, central processing unit ("CPU"), graphics processing unit ("GPU"), or system.

While various embodiments of the innovation have been described, it will be apparent to those of ordinary skill in the art that many more embodiments and implementations are possible within the scope of the innovation. Accordingly, the innovation is not to be restricted except in light of the attached claims and their equivalents.

What is claimed is:

1. A track lighting system comprising:

a track;

a plurality of luminaire connectors configured to couple with a plurality of luminaires, at least one of the luminaire connectors moveable relative to the track;

a flexible multi-line conductor comprising a plurality of conductors, at least one of the luminaire connectors configured to power a corresponding one of the luminaires from a corresponding set of the conductors, the corresponding set of the conductors for at least one of the luminaire connectors being different than the other corresponding sets of the conductors, the flexible multi-line conductor further configured to bend in response to movement of the luminaire connectors relative to the track; and a plurality of interposer circuits for the luminaire connectors, at least one of the interposer circuits being configured to select the corresponding set of the conductors for a corresponding one of the luminaire connectors.

2. The system of claim 1, wherein the flexible multi-line conductor is segmented into a plurality of sections, and at least one of the sections provides a corresponding one of the luminaire connectors with the corresponding set of the conductors.

3. The system of claim 2, wherein at least one of the sections provides at least one of the luminaire connectors with the corresponding set of the conductors at a location that is the same location on at least one of the sections.

4. The system of claim 1, wherein at least one of the interposer circuits is identified with a color that is different than other colors that identify the other of the interposer circuits.

5. The system of claim 1, wherein the flexible multi-line conductor comprises a flex circuit that includes a patterned arrangement of printed wiring on a flexible base material.

6. The system of claim 1, wherein the flexible multi-line conductor comprises a ribbon cable.

7. A flexible conductor assembly for lighting comprising:

a plurality of luminaire connectors configured to couple to a plurality of luminaires, at least one of the luminaire connectors moveable relative to another one of the luminaire connectors; and a flexible multi-line conductor comprising a plurality of conductors, at least one of the luminaire connectors configured to couple a corresponding one of the luminaires to a different set of the conductors than the other luminaire connectors are configured to couple to the other luminaires, the flexible multi-line conductor further configured to flex in response to movement of the luminaire connectors relative to each other, wherein the flexible multi-line conductor further comprises a plurality of sections coupled together with at least one pair shifting interposer; and wherein a respective one of the at least one pair shifting interposer shifts a set of the conductors in a first section of the flexible multi-line conductor to a different set of the conductors in a second section of the flexible multi-line conductor.

8. A flexible conductor assembly for lighting comprising:

a plurality of luminaire connectors configured to couple to a plurality of luminaires, at least one of the luminaire connectors moveable relative to another one of the luminaire connectors;

a flexible multi-line conductor comprising a plurality of conductors, at least one of the luminaire connectors configured to couple a corresponding one of the luminaires to a different set of the conductors than the other luminaire connectors are configured to couple to the other luminaires, the flexible multi-line conductor further configured to flex in response to movement of the luminaire connectors relative to each other, and an interposer circuit coupled to at least one of the luminaire connectors, wherein a position of one or more contacts on the interposer circuit dictates which of the conductors that the at least one of the luminaire connectors is to couple to the corresponding one of the luminaires.

9. A flexible conductor assembly for lighting comprising:

a plurality of luminaire connectors configured to couple to a plurality of luminaires, at least one of the luminaire connectors moveable relative to another one of the luminaire connectors; and a flexible multi-line conductor comprising a plurality of conductors, at least one of the luminaire connectors configured to couple a corresponding one of the luminaires to a different set of the conductors than the other luminaire connectors are configured to couple to the other luminaires, the flexible multi-line conductor further configured to flex in response to movement of the luminaire connectors relative to each other, wherein at least one of the luminaire connectors includes an interposer circuit, and wherein logic in the interposer circuit selects the conductors that the at least one of the luminaire connectors is to couple to the corresponding one of the luminaires.

10. The flexible conductor assembly of claim 9, wherein logic in the interposer circuit of at least one of the luminaire connectors selects the conductors based on communication with the interposer circuits in the other luminaire connectors.

11. The flexible conductor assembly of claim 9, wherein logic in the interposer circuit of at least one of the luminaire connectors selects the set of the conductors based on communication with a power device that supplies power over the conductors to the luminaire connectors.

12. A method to distribute power to a lighting system, the method comprising:

providing a plurality of luminaires, at least one of the luminaires moveable relative to another one of the luminaire connectors;

providing a flexible multi-line conductor comprising a plurality of conductors;

coupling at least one of the luminaires to the flexible multi-line conductor;

positioning the luminaires relative to each other, the flexible multi-line conductor bending in response to movement of the luminaires relative to each other when positioning the luminaires; and selecting a set of the conductors to power at least one of the luminaires, the set of the conductors for at least one of the luminaires being different than for the other luminaires, wherein selecting the set of the conductors comprises installing an interposer circuit in at least one of the luminaires.

13. The method of claim 12, wherein providing the flexible multi-line conductor comprises providing the flexible multi-line conductor in a housing of a track.

14. The method of claim 12, wherein selecting the set of the conductors comprises communicating over the conductors with a power device that supplies power to the luminaires over the conductors.

15. The method of claim 12 further comprising providing a Light Emitting Diode (LED) in a respective one of the luminaires.

* * * * *